US008021178B1

(12) United States Patent
Lee et al.

(10) Patent No.: US 8,021,178 B1
(45) Date of Patent: Sep. 20, 2011

(54) CARD EDGE CONNECTOR

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 12/851,777

(22) Filed: Aug. 6, 2010

(30) Foreign Application Priority Data

Jun. 29, 2010 (TW) ..... 99212305 U

(51) Int. Cl.
*H01R 4/38* (2006.01)

(52) U.S. Cl. ..... 439/326

(58) Field of Classification Search ..... 439/326–328, 439/79, 540.1, 541.5
See application file for complete search history.

(56) References Cited

U.S. PATENT DOCUMENTS

| | | | | |
|---|---|---|---|---|
| 7,427,208 | B2 * | 9/2008 | Yang et al. | 439/326 |
| 7,445,497 | B2 * | 11/2008 | Zhang | 439/541.5 |
| 7,771,222 | B2 * | 8/2010 | Li et al. | 439/326 |
| 7,789,692 | B2 * | 9/2010 | Lee | 439/327 |
| 7,794,259 | B2 * | 9/2010 | Zhu et al. | 439/327 |
| 7,815,452 | B2 * | 10/2010 | Lee et al. | 439/326 |
| 2004/0092148 | A1 * | 5/2004 | Yu | 439/326 |
| 2010/0167563 | A1 * | 7/2010 | Lee et al. | 439/77 |

* cited by examiner

*Primary Examiner* — Neil Abrams
*Assistant Examiner* — Phuong Nguyen
(74) *Attorney, Agent, or Firm* — Rosenberg, Klein & Lee

(57) ABSTRACT

A card edge connector includes an insulation body, a first assembly part, a second assembly part, a plurality of first terminals and a plurality of second terminals. The first terminals and the second terminals are respectively mounted into the first assembly part and the second assembly part. The first assembly part is assembled to the rear side of the insulation body, while the second assembly part is assembled to the lower side of the insulation body.

15 Claims, 13 Drawing Sheets

CARD EDGE CONNECTOR

This application claims the benefit of Taiwan Patent Application Serial No. 099212305, filed Jun. 29, 2010, the subject matter of which is incorporated herein by reference.

BACKGROUND OF THE INVENTION (1) Field of the Invention

The invention relates to a card edge connector, more particularly to an assembly-type card edge connector.

(2) Description of the Prior Art

It is usually to see variety connectors built inside to a housing of an electronic device such as a computer, a TV screen or any the like, to act as signal connection with respective foreign peripheral apparatuses.

Referring to FIG. 1, a typical card edge connector of aforesaid connectors is perspective shown. The connector 100 includes an insulation body 110, a plurality of metal leads 120, and two support arms 130 oppositely located to respective sides of the insulation body 110. The insulation body 110 is a one-piece plastic part having a plurality of insert holes 110. Each of the metal leads 120 has a contact end 121, a bifurcated fixing protrusion 122, an extension body 123 and a locating end 124.

In the art, the contact end 121 and the fixing protrusion 122 of each metal leads 120 are firstly inserted the respective insert hole 111 of the insulation body 110. In the assembly of the metal leads 120 into the insulation body 110, the assembling is failed if any of the metal leads 120 is mis-planted in the insert hole 111. At this time in the production stage, the whole set of the connecter 100 is abandoned, and, of course, a production cost hike from such abandonment is inevitable.

It is noted that the aforesaid metal lead 120 doesn't provide sufficient elasticity to act against an accidental mis-planting. Therefore, it can be expected that the mis-planting of the metal leads 120 to the insulation body 110 would be eventually met after several times of insert-and-pull-off operations between the metal leads 120 and the corresponding insulation body 110. As long as any mis-planting is there, the quality of the signal transmission of the connector 100 would be substantially degraded.

Further, as shown in the figure, for the metal leads 120 to be firmly fixed to the insulation body 110, each of the metal leads 120 has varying cross sections so as to be firmly anchored to the insulation body 110, such an configuration of the metal leads 120 anyhow sometimes won't provide stable signal transmission, especially in a high-capacity transmission requirement.

SUMMARY OF THE INVENTION

Accordingly, it is an object of the present invention to provide a card edge connector, which applies an insert-molded process to mount the terminals to a respective assembly part. Then, the assembly part is sent to be integrated with an insulation body. In addition, the present invention also provides the terminals sufficient elasticity so as to ensure the yield of pairing terminals.

In the present invention, the card edge connector includes an insulation body, a first assembly part, a plurality of first terminals, a second assembly part and a plurality of second terminals.

The insulation body has a receiving slot at a front side thereof and a first locating groove. The first assembly part is assembled to a rear side of the insulation body. The first terminals are fixed at the first assembly part and penetrating the insulation body to expose partly (mainly the tips) to the receiving slot. Each of the first terminals has a U-shaped first curve section and a U-shaped second curve section, while the first curve section connects the section to form a wavy structure. The second assembly part is assembled to a lower side of the insulation body. The second terminals are fixed at the second assembly part and penetrating the insulation body to expose partly to the receiving slot. Each of the second terminals has a U-shaped third curve section. When a connection module is introduced to engage the receiving slot, the first curve section is pushed by the connection module. In the present invention, both the first terminal and the second terminal can be bent from a long rod metal structure.

By providing insert molding to mount the terminals into the respective assembly part in the present invention, production precision and yield of the connector can be increased. Also, to form the terminal from bending a long rod metal structure, the terminal's elasticity can be ensured to guarantee the following frequent pull-off operations between the connection module and the card edge connector. Further, for a unique cross section is provided to the terminal of the present invention, quality of signal transmission, especially the high-capacity transmission, can be assured.

All these objects are achieved by the card edge connector described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a card edge connector. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
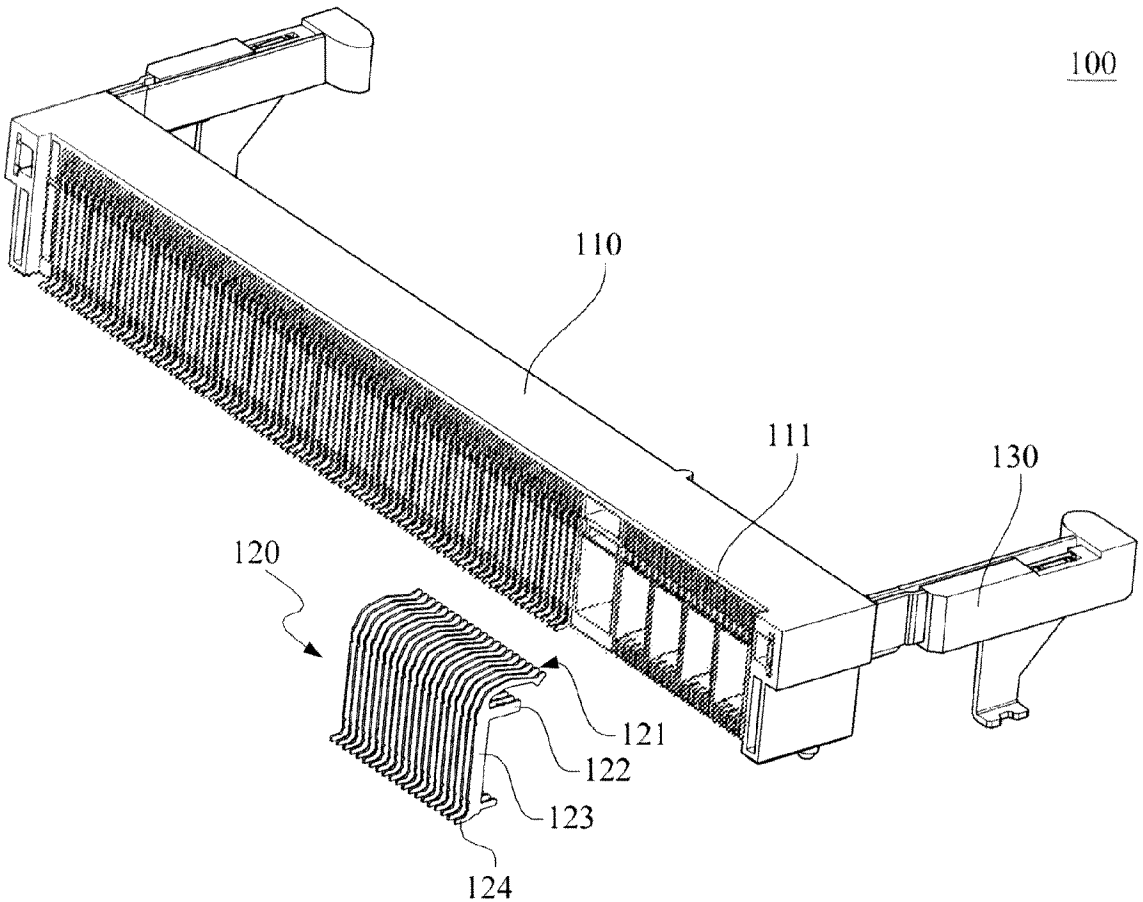
FIG.1(Prior Art)
FIG. 1 is a perspective view of a conventional card edge connector.
Figure 2:
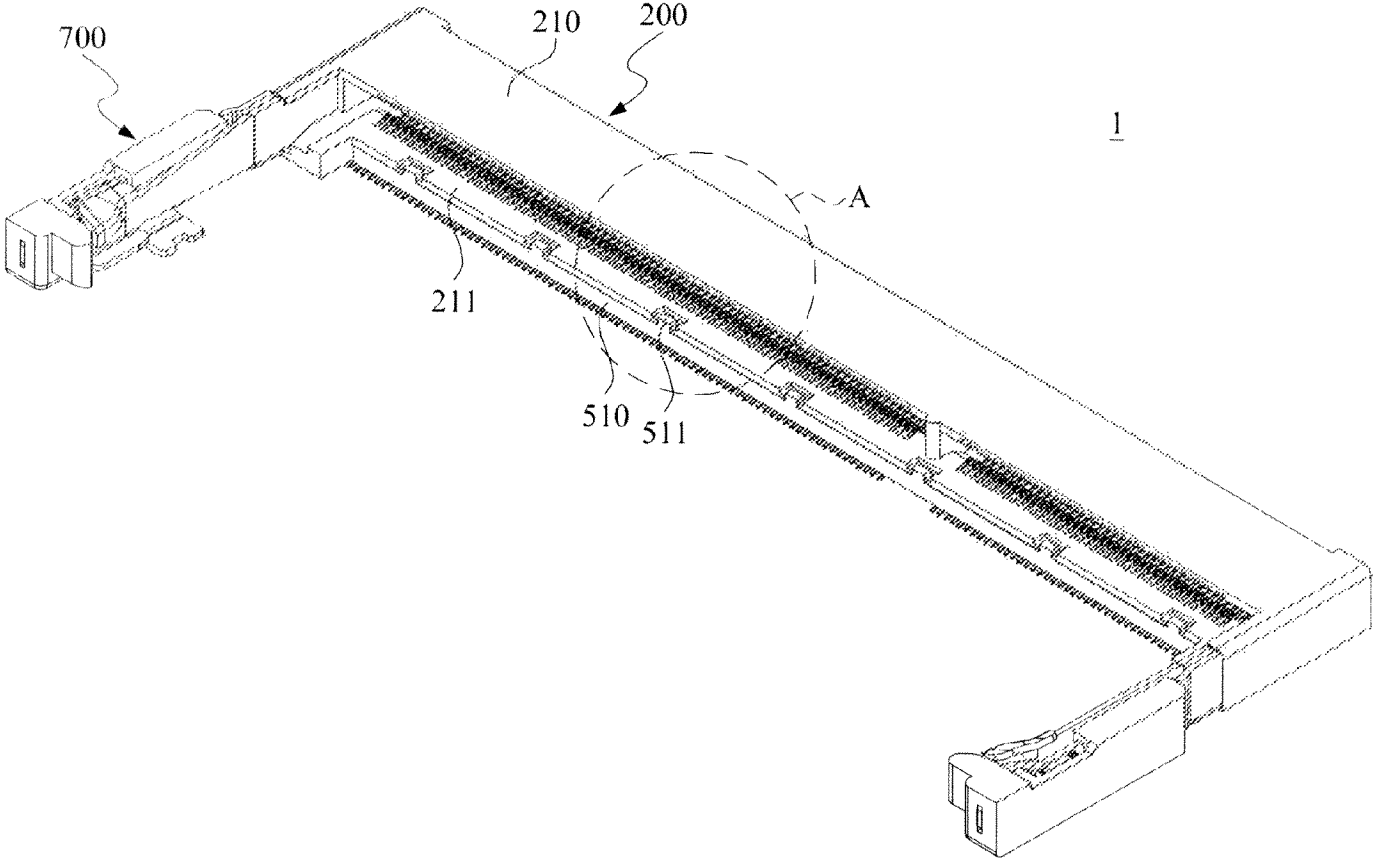
FIG. 2 is a perspective view of a preferred embodiment of the card edge connector in accordance with the present invention.
Figure 3:
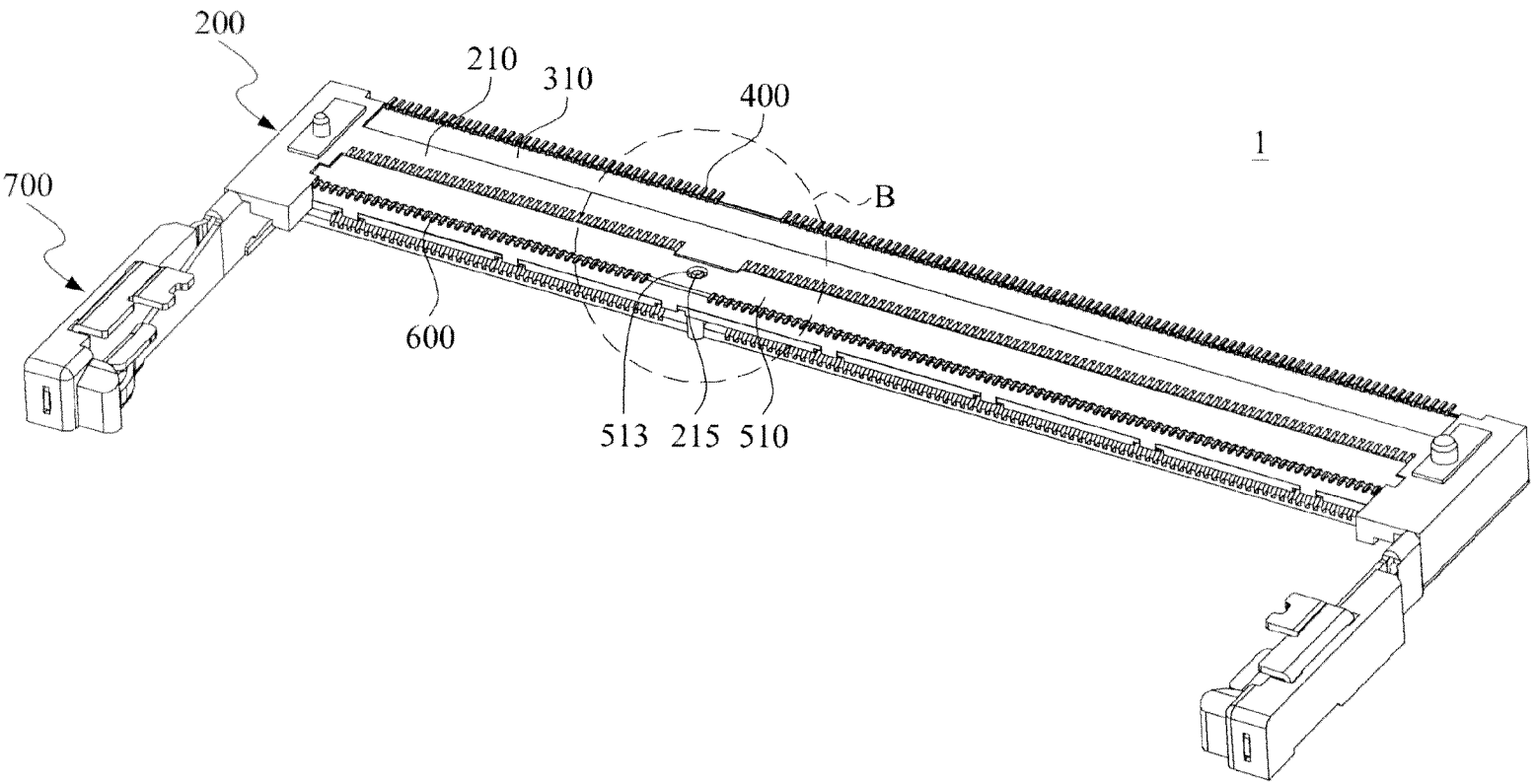
FIG. 3 is another view of FIG. 2.
Figure 4:
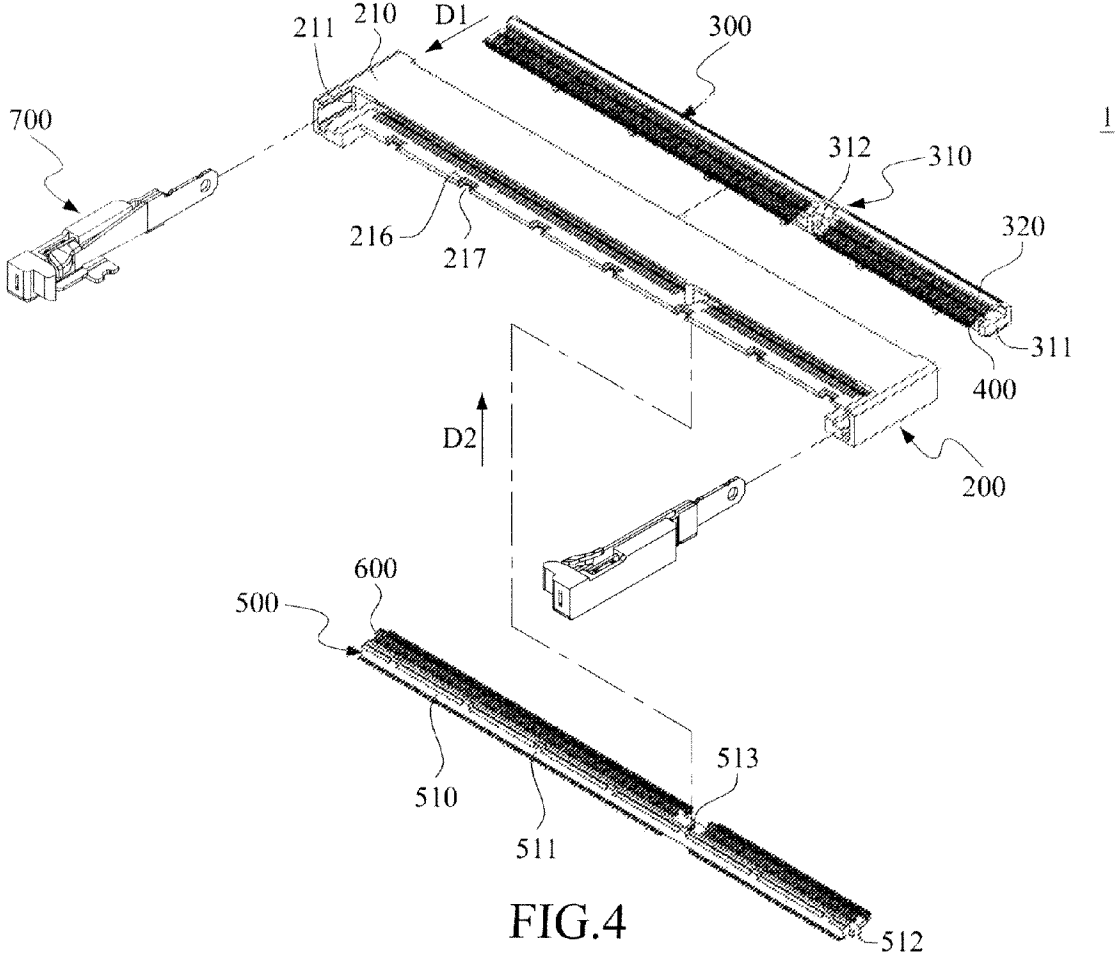
FIG. 4 is an exploded view of the card edge connector of FIG. 2.

Referring now to FIG. 2, FIG. 3 and FIG. 4, a first (preferred) embodiment of the card edge connector in accordance with the present invention is shown in various views. The card edge connector 1 includes an insulation body 200, a first assembly part 300, a plurality of first terminals (metal leads) 400, a second assembly part 500, a plurality of second terminals 600 and two clamp arms 700. The insulation body 200 has a pair of receiving slots located on and extended along a front side thereof. The first assembly part 300 extended along a first assembly direction D1 is assembled to the insulation body 200 from a rear side of the insulation body 200. The first terminals 400 are insert molded to the first assembly part 300. As the first assembly part 300 is mounted into the insulation body 200, front tips of the first terminals 400 are exposed to the receiving slots 211. The second assembly part 500 extended along a second assembly direction D2 is assembled to the insulation body 200 from a lower side of the insulation body 200. The second terminals 500 are insert molded to the second assembly part 500. The second assembly direction D2 is perpendicular to the first assembly direction D1.

The two clamp arms 700 located oppositely to two lateral ends of the insulation body 200 are symmetrically extended along the first assembly direction D1. An adjunction module 3 (see FIG. 9) is to be plugged into the receiving slot 211. While the adjunction module 3 is nested inside the receiving slot 211, the two clamp arms 700 are to clamp the adjunction module 3 at both sides thereof. In this present invention, the adjunction module 3 can be a memory device, a pairing connector, or any the like.

Figure 5:
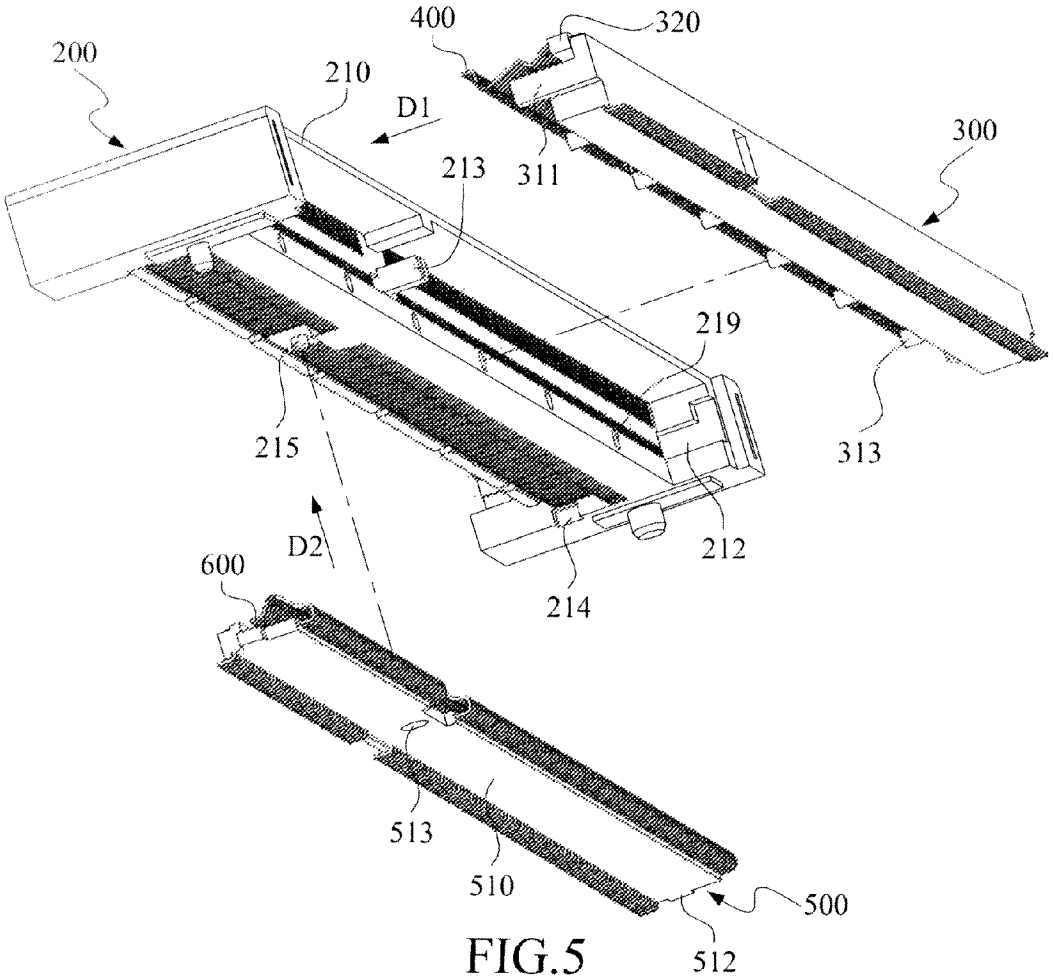
FIG. 5 is another exploded view of the card edge connector of FIG. 2.

Referring now to FIG. 4 and FIG. 5, two exploded views, in different viewing angles, of the card edge connector are shown. The insulation body 200 includes a body unit 210, the receiving slot 211, two first locating grooves 212, a second locating protrusion 213, two second locating grooves 214, a third buckling protrusion 215, a plurality of first buckling grooves 216, and a plurality of fourth locating grooves 219.

The body unit 210 is the base structure of the insulation body 200. An upper side, a lower side, a front side and a rear side of the insulation body 200 are defined respectively to the corresponding upper, lower, front and rear sides of the body unit 210.

The receiving slot 211 for receiving the connection module 3 is constructed concavely at the front side of the body unit 210. The first locating grooves 212 are located respectively at both ends of the body unit 210. The second locating protrusion 213 is protruded from a part of the rear side of the body unit 210. The second locating groove 214 is extended along the second assembly direction D2. The third buckling protrusion 215 is protruded from the lower side of the body unit 210. The first buckling grooves 216 are located at the lower side of the body unit 210, spaced to each other by a predetermined interval under the receiving slot 211. A first buckling hole 217 is located at a bottom portion of the first buckling groove 216. The fourth locating grooves 219 are interval arranged at a lower edge of the rear side of the body unit 210.

The first assembly part 300 includes a first assembly body 310, two first locating protrusions 311, a third locating groove 312, a terminal locating part 320, and a plurality of third locating, protrusions 313. The first assembly body 310 as the main construction part of the first assembly part 300 has two lateral sides and a front side to define the two lateral sides and the front side of the assembly part 300. The first terminal 400 is fixed at the first assembly body 310 by the terminal locating part 320. The terminal locating part 320 as shown can be a long rod structure spaced from the first assembly body 310 by a predetermined spacing. The first locating protrusion 311 is constructed to each lateral side of the first assembly body 310. Preferably, the first locating protrusion 311 and the pairing first locating groove 312 can be L-shaped. The third locating protrusions 313 are arranged in a manner of equal spacing to the front side of the first assembly body 310 so as to match the fourth locating groove 219 of the insulation body 200.

When the first assembly part 300 is assembled to the insulation body 200, the first locating protrusion 311 is moved along the first assembly direction D1 to anchor in the first locating groove 212, the second locating protrusion 213 of the insulation body 200 is also located inside the fourth locating groove 219, and the third locating protrusion 313 is at this time restrained inside the fourth locating groove 219. Upon such a locating arrangement, the first assembly part 300 can be then fixed onto the insulation body 200. Also, in the assembly state, the first terminals 400 penetrate through the insulation body 200 so as to expose tips thereof to the receiving slot 211. For the first terminals 400 are insert-molded into the first assembly part 300, all space relations among the first terminals 400 are solidly fixed. Therefore, while the first assembly part 300 is assembled to the insulation body 200, the first terminals 400 can be precisely mounted into the insulation body 200 by helps of the first locating protrusion 311, the second locating protrusion 213 and the third locating protrusion 310. Accordingly, production rate and the yield of the connector of the present invention can be increased.

The second assembly part 500 includes a second assembly body 510, a plurality of first locating protrusions 511, two second locating protrusions 512, and a second locating hole 513. The second assembly body 510 as the main construction part of the second assembly part 500 has two lateral sides, a front side, an upper side and a lower side also to be defined equally as the two lateral sides, the front side, the upper side and the lower side of the assembly part 510. The first locating protrusion 511 is constructed at the upper side of the second assembly body 510.

Figure 6:
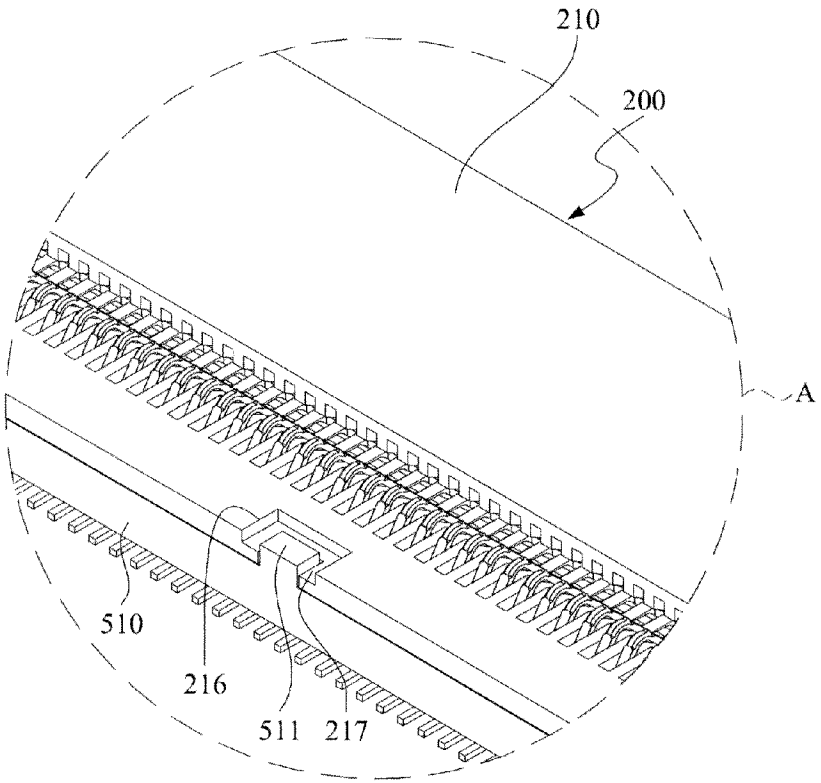
FIG. 6 is an enlarged view of circle A of FIG. 2.

Referring also to FIG. 6, the first locating protrusion 511 is to penetrate the first locating hole 217 and to be exposed to the receiving slot 216 along the second assembly direction D2. In this embodiment as shown, a glue material can be injected between the first locating groove 216 and the first locating protrusion 511 so as to further combine the second assembly part 500 and the insulation body 200.

Figure 7:
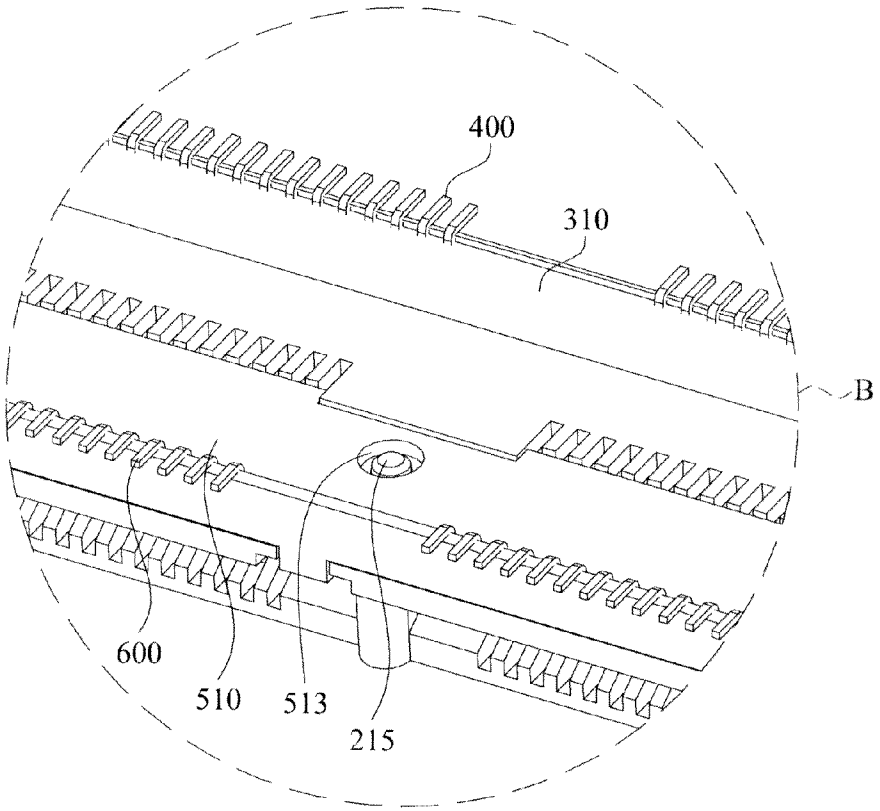
FIG. 7 is an enlarged view of circle B of FIG. 3.

Similarly, refer also to FIG. 7. The third locating protrusion 215 is accommodated inside the second locating hole 513. The glue material can also be injected between the third locating protrusion 215 and the second locating hole 513 for firmly holding the second assembly part 500 and the insulation body 200. Upon such a gluing arrangement, the binding of the present invention can be superior to that of prior art in integrating the second assembly part 500 and the insulation body 200. Similarly as well, the second terminals 600 can be precisely mounted in the insulation body 200, as the first terminals 400 do.

Figure 8:
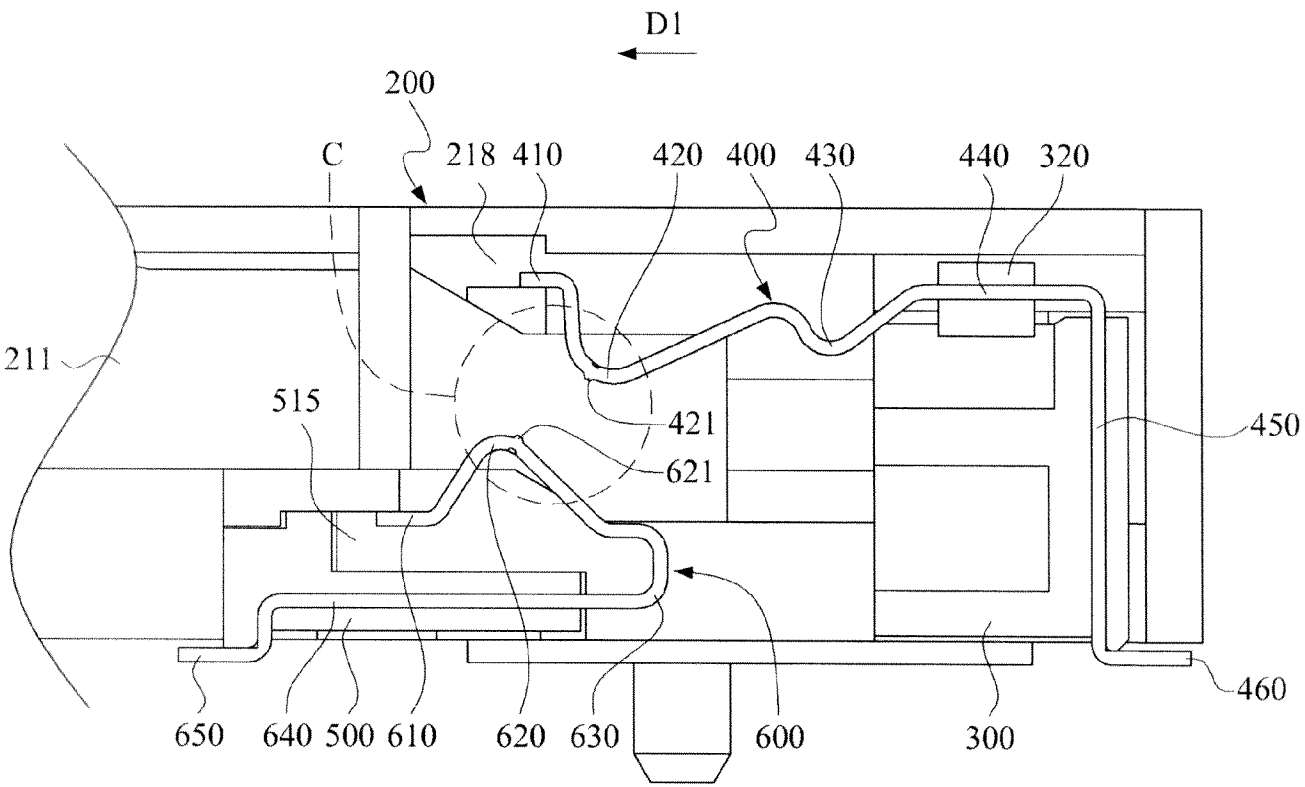
FIG. 8 is a cross sectional view upon one portion of the preferred card edge connector of FIG. 2.
Figure 9:
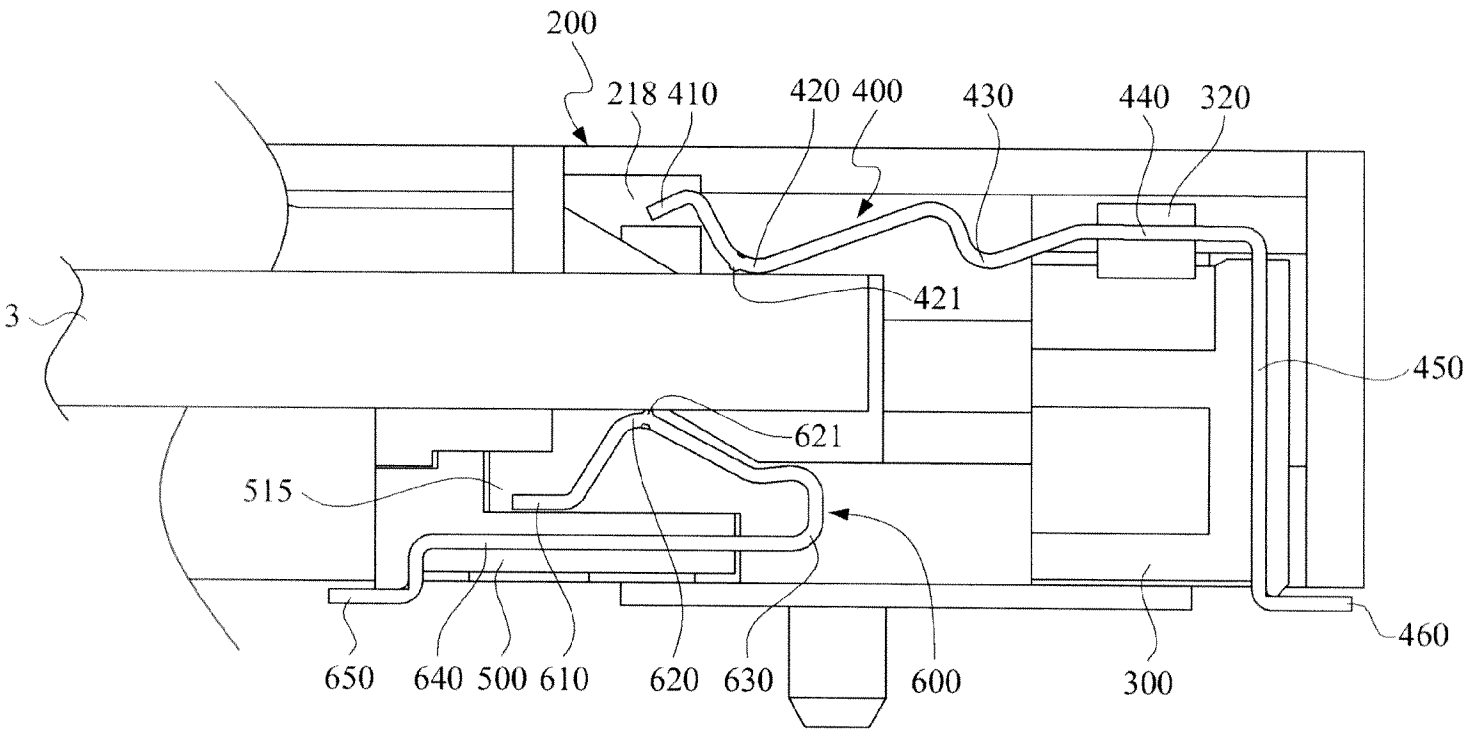
FIG. 9 is another view of FIG. 8 in another state.

Referring now to FIG. 8 and FIG. 9, two cross sectional views (in different states) upon a portion of the connector in accordance with the present invention are provided. The first terminal 400 formed as a long wire structure can be punched and bent to form from a raw metal sheet. Each of the first terminals 400 includes a first locating end 410, a first curve section 420, a second curve section 430, a connection section 440, a first locating section 450 and a contact end 460. The first locating end 410 can be movably installed to a first locating groove 218 of the insulation body 200. The first locating groove 218 is communicated in space with the receiving slot 211. While the connection module 3 is absent from the insulation body 200, the first locating end 410 is depressed against a lower side of the first locating groove 218.

The first curve section 420 and the second curve section 430 are both U-shaped and connected continually into a wavy structure. As shown, the top of the first curve section 420 can be lower than that of the second curve section. The terminal locating part 320 is to fix the connection section 440 so as to uphold the spacing between two adjacent terminals 400. The first locating section 450 is fixed to the first assembly part 300. The first contact end 460 can be welded or soldered to a printed circuit board (not shown in the figure). Further, for the first terminals 400 of the preset invention can be manufactured from a metal plate, insert-molded into an integral set, and then bent into the final shape, the position relationship (i.e. spacing) among the first terminals 400 can be ensured.

Each of the second terminal 600 formed as a long wire structure includes a second restraint end 610, a third curve section 620, a bent section 630, a second locating section 640, and a second connection end 650. As shown, a second restraint groove 515 is formed between the insulation body 200 and the second assembly part 500. The second restraint end 610 can be movably located into the second restraint groove 515. When the connection module 3 is away from the insulation body 200, the second restraint end 610 is depressed against an upper side of the second restraint groove 515. Both the third curve section 620 and the bent section 630 are U-shaped. The bent section 630 is extended substantially along the first assembly direction D1. The third curve section 620 is located above the second locating section 640. The second locating section 640 is fixed to the second assembly part 500. The second connection end 650 can be welded or soldered to a printed circuit board.

As shown in FIG. 9, when the connection module 3 is engaged into the receiving slot 211, the first curve section 420 and the third curve section 620 are pushed by the incoming connection module 3 so as to have the first restraint end 410 contact against the upper side of the first restraint groove 218, and also to have the second restraint end 610 contact against the lower side of the second restraint groove 515 (i.e. at the second assembly part 500). For the first terminals 400 and the second terminals 600 of the present invention can provide considerable resilience, sufficient and firm clamping between the terminals 400, 600 and the incoming terminals (not shown in the figure) of the connection module 3 can exist to maintain satisfactory electric engagement in between. Thereby, the signal transmission quality of the connector can be increased. Further, due to elastic structuring provided by the present invention, the card edge connector 1 can still ensure the connection in between with the connection module 3, even after experiencing a considerable number of pull-off operations, and thus the service life of the card edge connector 1 can then be increased.

Figure 10:
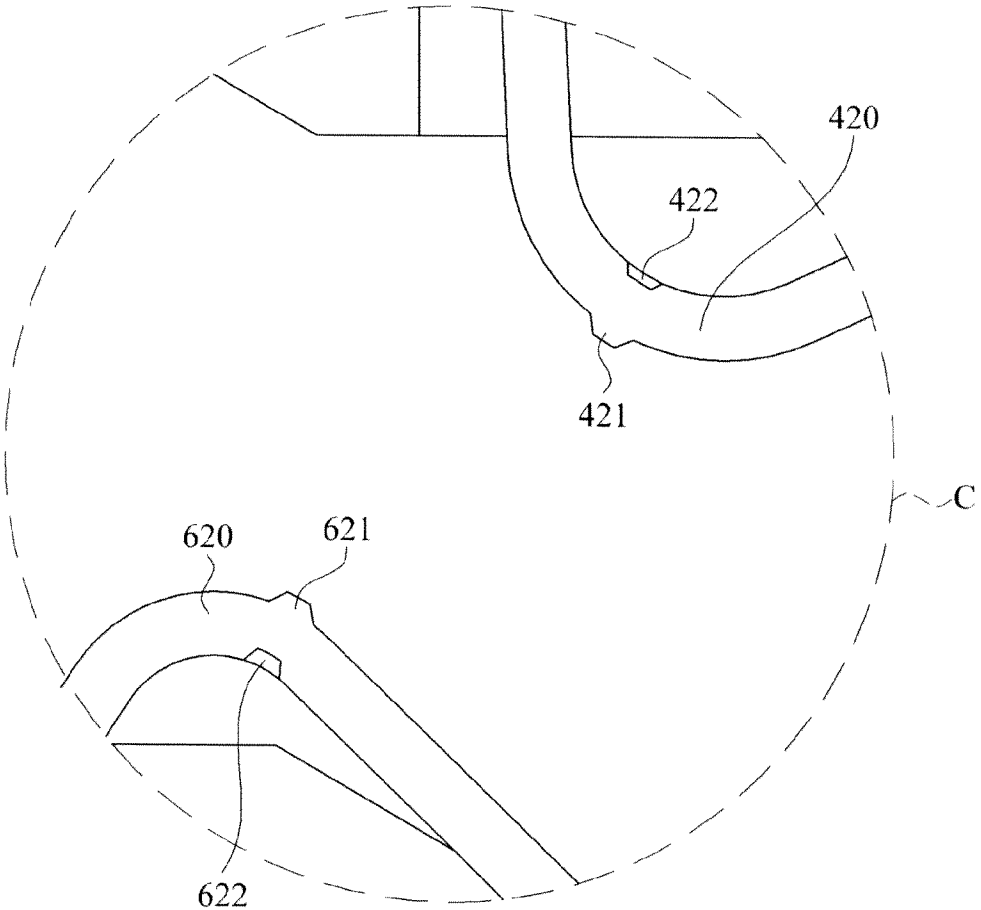
FIG. 10 is an enlarged view of circle C of FIG. 8.

Referring now to FIG. 10, the first curve section 420 has a first scratch protrusion 421 at a top thereof, and the third curve section 620 has a second scratch protrusion 621 at a top thereof. The first scratch protrusion 421 and the second scratch protrusion 621 are to apply forcing respectively to the upper surface and the lower surface of the connection module 3. While the connection module 3 is moved (in or out) with respect to the receiving slot 211, the first scratch protrusion 421 and the second scratch protrusion 621 can be used to wipe off possible oxidants on the respective terminals of the connection module 3. Upon such an arrangement, the later-on electric connection between the card edge connector 1 and the connection module 3 can be guaranteed. In the present invention, the first scratch protrusion 421 and the first groove 422 can be formed from an operation in manufacturing the first terminal 400. Similarly, the second scratch protrusion 621 and the second groove 622 can be formed from an operation in manufacturing the second terminal 600.

Figure 11:
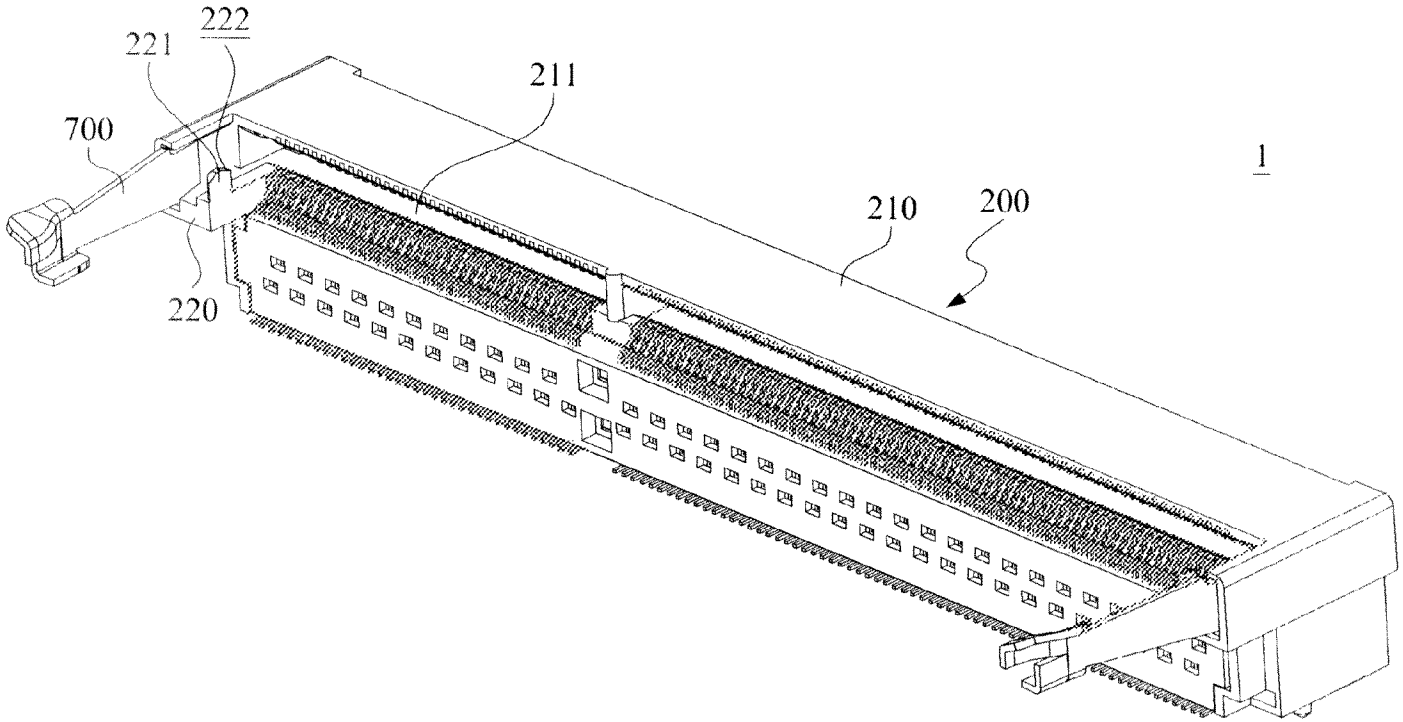
FIG. 11 is a perspective view of another embodiment of the card edge connector in accordance with the present invention.

Referring now to FIG. 11, a second embodiment of the card edge connector in accordance with the present invention is shown. Major differences between the second embodiment and the first embodiment (the previous preferred embodiment) are that the height of the insulation body 200 of the second embodiment is higher than that of the first embodiment and also the clamp arms 700 of the second embodiment are much simply structured. Further, in this second embodiment, a supportive protrusion 220 is extended along the first assembly direction D1 from the respective lateral side of the body unit 210 at a location neighboring the receiving slot 211. Also, a restraint protrusion 221 is protruded from a top of the supportive protrusion 220 and has an oblique restraint surface 222.

Figure 12:
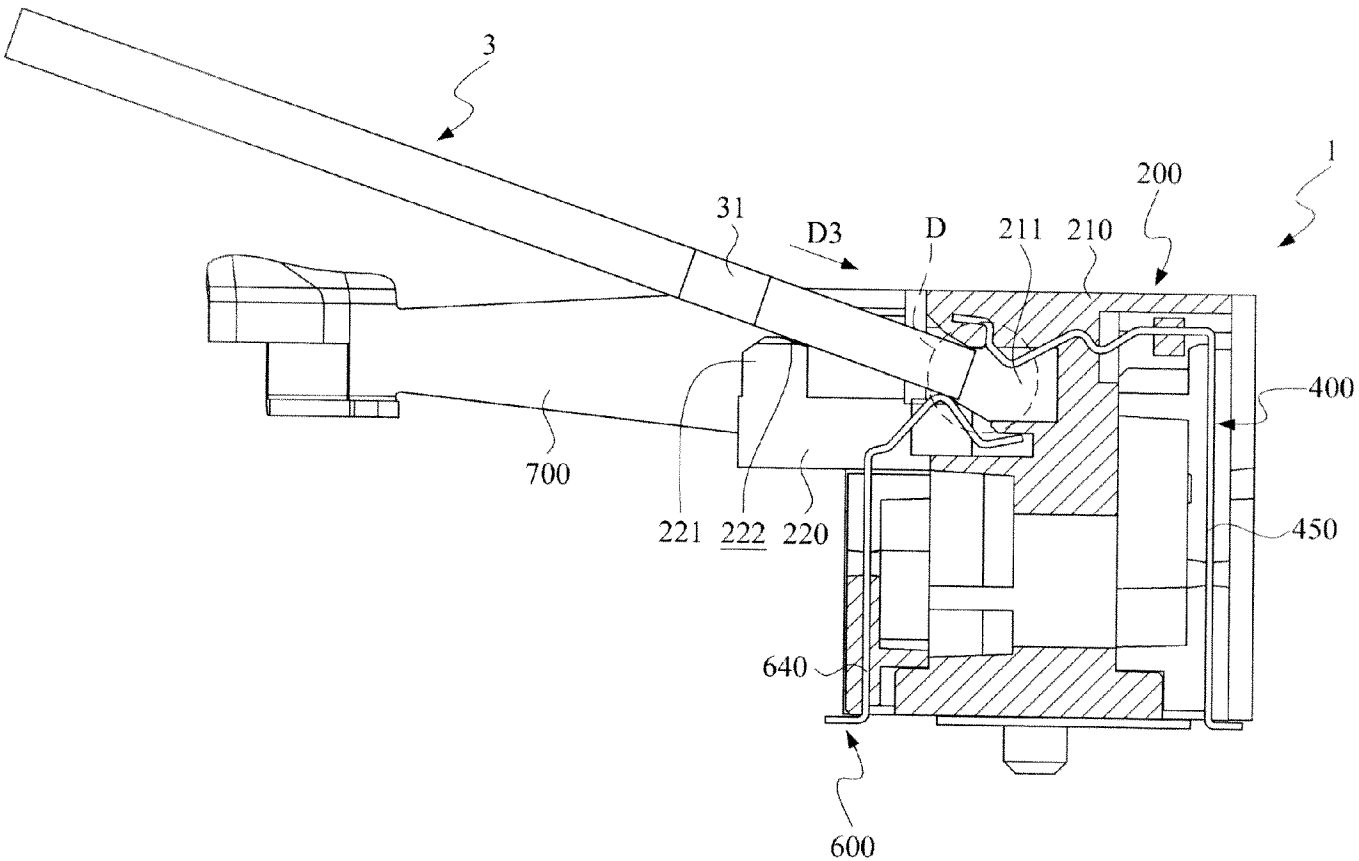
FIG. 12 shows an operational state of the card edge connector of FIG. 11.

Referring now to FIG. 12, an operational state of the second embodiment of the card edge connector is shown. The connection module 3 has a restraint hole 31. The oblique restraint surface 222 of the restraint protrusion 221 is extended along a connection direction D3. As shown, while the connection module 3 is inserted into the receiving slot 211 of the insulation body 200 from a right-hand side of the figure, the restraint protrusion 221 is to contact against the connection module 3 so as to have the connection module 3 slide along the oblique restraint surface 222. Namely, as the connection module 3 moves along the connection direction D3, the restraint protrusion 221 would insert the restraint hole 31 so as to alter the movement of the connection module 3 from the connection direction D3 to a horizontal direction, and thus the connection module 3 can correctly engage with the card edge connector 1. At this time, it is easy to see that the supportive protrusion 220 supports the connection module 3.

In the present invention, the restraint protrusion 221 having the oblique restraint surface 222 can guide a correct incoming angle of the connection module 3. Therefore, operation smoothness of introducing a module to the card edge connector can be assured. In addition, the combination of the restraint protrusion 221 and the restraint hole 31 is to prevent from possible misalignment in engaging a foreign module (3) into the card edge connector 1.

Figure 13:
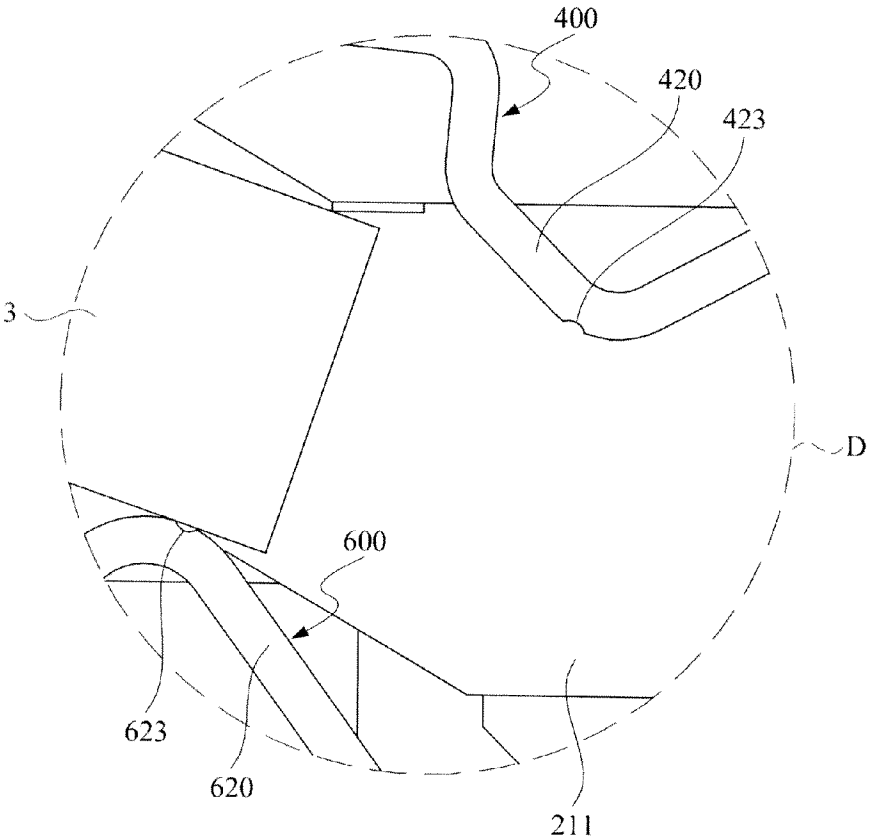
FIG. 13 is an enlarged view of circle D of FIG. 12.

Refer now to FIG. 12 and FIG. 13 which is an enlarged view of circle D of FIG. 12. In the second embodiment, the first scratch groove 423 and the second scratch groove 623 are used to replace the first scratch protrusion 421 and the second scratch protrusion 621 of the first embodiment, and the design of first groove 422 and the second groove 622 can be removed. In forming the first scratch groove 423 and the second scratch groove 623, a press operation can be applied to the first curve section 420 of the first terminal 400 and the third curve section 620 of the second terminal 600.

In this second embodiment, the advantage from applying the first scratch groove 423 and the second scratch groove 623 is that the oxidants on the connection module 3 can be wiped off by and collected into the first scratch groove 423 and the second scratch groove 623. Upon such an arrangement, the scratches would be avoided from dropping into other parts of the first terminal 400 and the second terminal 400. Further, to pair the height increase of the insulation body 200, the first locating section 450 of the first terminal 400 is prolonged. The second locating section 640 of the second terminal 600 is vertical so as to be parallel to the first locating section 450.

By providing insert molding process to include the first terminal and the second terminal respectively into the first assembly part and the second assembly part, the yield in assembling the first assembly part and the second assembly part into the insulation body of the card edge connector can be substantially increased. Further, the service life of the terminals can be increased by providing elastic structure as described above to the terminals of the present invention.

Also, for the cross sections of the terminal is unique, as being formed as a long rod structure, the signal transmission quality can be ensured.

While the present invention has been particularly shown and described with reference to a preferred embodiment, it will be understood by those skilled in the art that various changes in form and detail may be without departing from the spirit and scope of the present invention.

We claim:

1. A card edge connector, comprising:

an insulation body, having a receiving slot at a front side thereof and a first locating groove;

a first assembly part, assembled to a rear side of the insulation body;

a plurality of first terminals, fixed at the first assembly part and penetrating the insulation body to expose partly to the receiving slot, each of the first terminals having a U-shaped first curve section and a U-shaped second curve section, the first curve section connecting the section to form a wavy structure;

a second assembly part, assembled to a lower side of the insulation body; and a plurality of second terminals, fixed at the second assembly part and penetrating the insulation body to expose partly to the receiving slot, each of the second terminals having a U-shaped third curve section;

wherein, when a connection module is introduced to engage the receiving slot, the first curve section is pushed by the connection module;

wherein said insulation body further has a first buckling groove at a lower side thereof, the first buckling groove further having a first buckling hole at a bottom thereof, said second assembly part further having a first buckling protrusion at an upper side thereof, wherein the first buckling protrusion penetrates the first buckling hole to expose to the first buckling groove;

a glue material between said first buckling groove and said first buckling protrusion.

2. The card edge connector according to claim 1, wherein said first terminal further has a first locating end movably located in said first locating groove by contacting against a lower side of the first locating groove; wherein, when said connection module engages said receiving slot, said connection module pushes said first curve section to have the first locating end contact against an upper side of said first locating groove.

3. The card edge connector according to claim 1, wherein said first curve section further has a first scratch protrusion for applying a force onto a surface of said connection module.

4. The card edge connector according to claim 1, wherein said third curve section further has a second scratch protrusion for applying a force onto another surface of said connection module.

5. The card edge connector according to claim 1, wherein said first curve section further has a first scratch groove for wiping off oxidants on said connection module.

6. The card edge connector according to claim 1, wherein said third curve section further has a second scratch groove for wiping off oxidants on said connection module.

7. The card edge connector according to claim 1, wherein said insulation body further has a pair of first locating grooves located to respective lateral sides thereof, and said first assembly part further has a pair of first locating protrusions located to respective lateral sides thereof for engaging the corresponding first locating grooves.

8. The card edge connector according to claim 1, wherein said first locating groove and said locating protrusion are both L-shaped.

9. The card edge connector according to claim 1 further including a second locating groove located between said insulation body and said second assembly part, said second terminal having a second locating end movably located in said second locating groove by contacting against an upper side of said second locating groove; wherein, when said connection module engages said receiving slot, said connection module pushes said third curve section to have the second locating end contact against a lower side of said second locating groove.

10. The card edge connector according to claim 9, wherein said second terminal has said second locating end, said third curve section, a bent section and a second locating section, said third curve section connecting the bent section to form a U-shaped structure, said third curve section being located above said second locating section.

11. The card edge connector according to claim 1, wherein said insulation body further has a third buckling protrusion at a lower side thereof, and said second assembly part has a second buckling hole to accommodate the third buckling protrusion.

12. The card edge connector according to claim 11 further including a glue material between said third buckling protrusion and said second buckling hole.

13. The card edge connector according to claim 1 further having a supportive protrusion extended from a respective lateral side of said insulation body at a location neighboring said receiving slot, a restraint protrusion being protruded from the supportive protrusion.

14. The card edge connector according to claim 13, wherein said restraint protrusion further has an oblique restraint surface for sliding said connection module when said connection module is engaging said receiving slot.

15. The card edge connector according to claim 14, wherein said connection module further has a restraint hole for rotating said connection module so as to have said restraint protrusion correctly plug said receiving slot when said connection module is ready to engage said receiving slot.

* * * * *